US009198248B2

(12) United States Patent
Kim et al.

(10) Patent No.: US 9,198,248 B2
(45) Date of Patent: Nov. 24, 2015

(54) LED LIGHTING DEVICE AND LED LIGHTING CONTROL METHOD

(71) Applicant: SILICON WORKS CO., LTD., Daejeon-si (KR)

(72) Inventors: Yong Geun Kim, Suwon-si (KR); Jin Seok Hong, Daejeon-si (KR); Jung Hee Seo, Daejeon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 31 days.

(21) Appl. No.: 14/257,831

(22) Filed: Apr. 21, 2014

(65) Prior Publication Data

US 2014/0312805 A1 Oct. 23, 2014

(30) Foreign Application Priority Data

Apr. 19, 2013 (KR) ..... 10-2013-0043778

(51) Int. Cl.
*H05B 37/02* (2006.01)
*H05B 33/08* (2006.01)

(52) U.S. Cl.
CPC ..... *H05B 33/0845* (2013.01)

(58) Field of Classification Search
CPC ..... H05B 33/0803; H05B 33/0806; H05B 37/02; H05B 41/3927; H05B 41/36
USPC ..... 315/291, 294, 297, 307–308
See application file for complete search history.

(56) References Cited

U.S. PATENT DOCUMENTS

| | | | | |
|---|---|---|---|---|
| 2008/0088254 | A1 | 4/2008 | Yang | |
| 2010/0277072 | A1 | 11/2010 | Draper et al. | |
| 2011/0266976 | A1 | 11/2011 | Zhang et al. | |
| 2012/0098435 | A1 * | 4/2012 | Tseng | 315/130 |

FOREIGN PATENT DOCUMENTS

| | | |
|---|---|---|
| KR | 10-0681392 | 2/2007 |
| KR | 10-2012-0039394 | 4/2012 |

* cited by examiner

*Primary Examiner* — Jason M Crawford
(74) *Attorney, Agent, or Firm* — Kile Park Reed & Houtteman PLLC

(57) ABSTRACT

An LED lighting device comprises an LED light source unit; a light intensity control unit configured to provide a light intensity control signal for controlling a light intensity through a plurality of steps in a light intensity control mode; and a light source driving unit configured to provide power to the LED light source unit according to the light intensity control signal.

14 Claims, 6 Drawing Sheets

LED LIGHTING DEVICE AND LED LIGHTING CONTROL METHOD

BACKGROUND OF THE INVENTION

1. Field of the Invention

The present invention relates to an LED lighting device, and more particularly, to an LED lighting device capable of controlling the light intensity of a light source.

2. Description of the Related Art

An LED lighting device may be configured to emit light using a lighting emitting diode (ELD) as a light source and control the light emission state, if necessary, and used as a security light or streetlamp.

Korean Patent Laid-open Publication No. 10-2012-0039394 discloses a lighting device which recognizes a moving object or person, intelligently recognizes the environment in which the lighting device is installed, detects environmental elements so as to preferentially perform safety, security, and warning functions for users in a limited space, and reduces electric energy according to various functional elements.

Korean Patent No. 10-0681392 discloses a lighting control device having a wireless security and control function. The lighting control device uses an infrared sensor and an ultrasonic sensor and is wirelessly connected to a control system. When the sensors are operated, the lighting control device transmits an image photographed with a CCD camera and manages entry and exit of people.

The lighting devices disclosed in the related arts control light emission according to a simple analog method.

LED light sources made by different manufacturers may have a difference in light intensity therebetween, even though they have the same specification. An LED lighting device may employ LED light sources made by a variety of manufacturers, and needs to reduce the difference in light intensity among the LED light sources, in order to secure the reliability of the product.

SUMMARY OF THE INVENTION

Accordingly, the present invention has been made in an effort to solve the problems occurring in the related art, and an object of the present invention is to provide an LED lighting device capable of precisely controlling the light intensity of an LED light source and performing a light intensity control mode in a digital manner, and an LED lighting control method.

Another object of the present invention is to provide an LED lighting device capable of providing a normal mode and a light intensity control mode, resolving a difference in light intensity between LED light sources made by different manufactures and simply changing the normal mode and the light intensity control mode in relation with a connection time and an electrical connection state among a plurality of open-circuit voltage pins, and an LED lighting control method.

Another object of the present invention is to provide an LED lighting device capable of providing a light intensity control mode for controlling the light intensity of an LED light source, adjusting the duty ratio of a light intensity control signal in relation with a connection time and an electrical connection state among a plurality of open-circuit voltage pins in a state where the LED lighting device enters the light intensity, and an LED lighting control method.

Another object of the present invention is to provide an LED lighting device capable of controlling the light intensity of an LED light source through communication using an external user management terminal and an LED lighting control method.

In order to achieve the above object, according to one aspect of the present invention, an LED lighting device may include: an LED light source unit; a light intensity control unit configured to provide a light intensity control mode, provide a light intensity control signal for changing a light intensity after entering the light intensity control mode, and set the light intensity control mode or change the light intensity control signal by referring to a connection state among a plurality of open-circuit voltage pins; and a light source driving unit configured to control a power signal provided to the LED light source unit according to the light intensity control signal.

According to another aspect of the present invention, an LED lighting control method may include: recognizing any one of a normal mode for maintaining a light intensity of an LED light source by referring to a connection state among a plurality of open-circuit voltage pins and a light intensity control mode for controlling the light intensity of the LED light source in stages; performing the normal mode for maintaining the light intensity of the LED light source by maintaining a duty ratio of a light intensity control signal provided from a pulse generation module in response to the normal mode; and performing the light intensity control mode for controlling the light intensity of the LED light source by increasing or decreasing the duty ratio of the light intensity control signal provided from the pulse generation module in response to the light intensity control mode.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
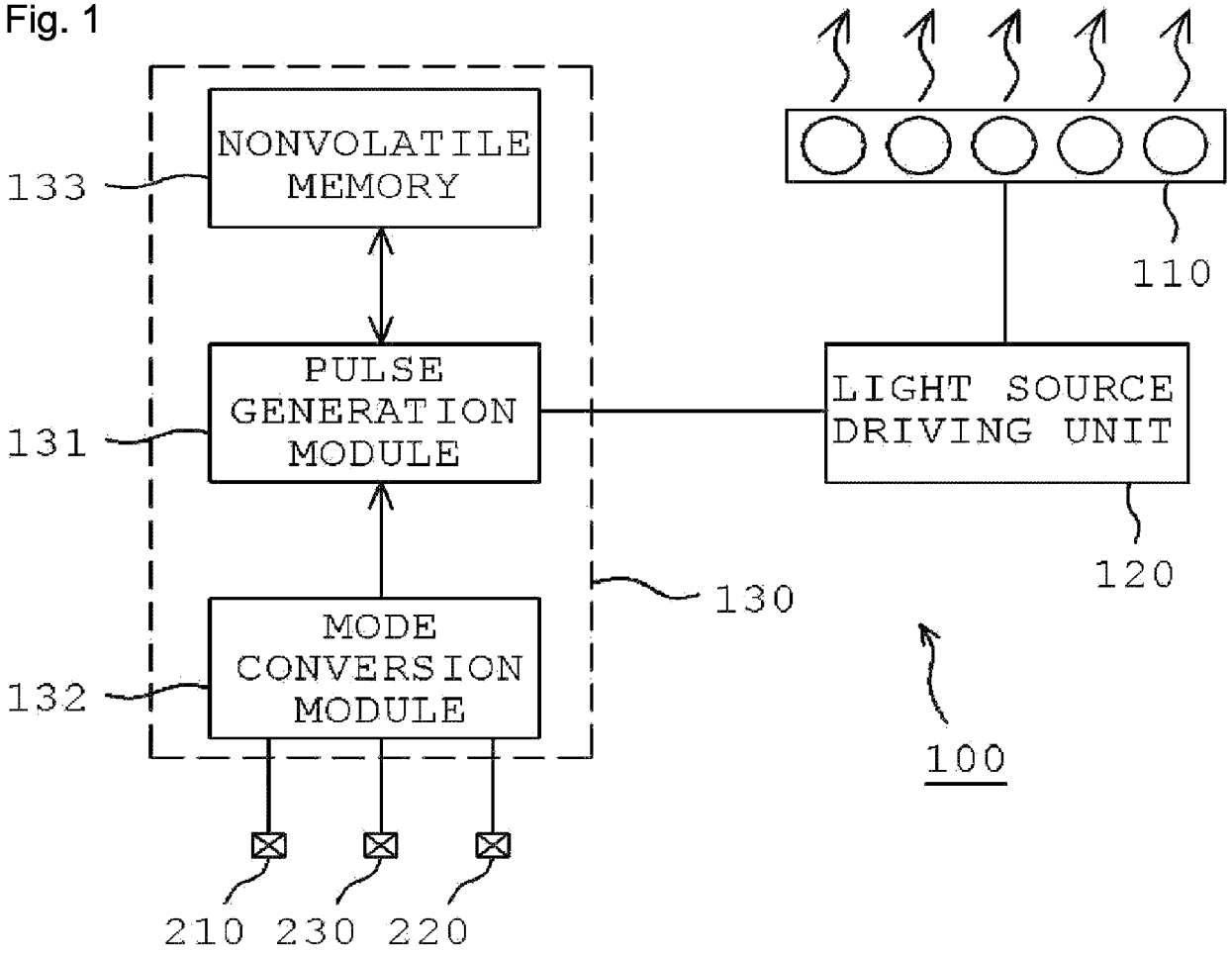
FIG. 1 is a diagram illustrating an LED lighting device according to an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a diagram illustrating an LED lighting device according to an embodiment of the present invention. Referring to FIG. 1, the LED lighting device 100 includes an LED light source unit 110, a light source driving unit 120, a light intensity control unit 130.

The LED light source unit 110 uses an LED as a light source, and has a longer lifespan and faster response speed than devices using other light sources. The LED light source unit 110 receives power required for light emission from the light source driving unit 120, and the brightness of the LED light source unit 110 may be adjusted according to the amount of power. The LED light source unit 110 may be configured to sense surrounding environment such as illuminance and control a light intensity.

The LED light source included in the LED light source unit 110 may have a different maximum light intensity depending on a manufacturer. Thus, when an LED light source having a different specification from a preset LED light source is employed, the LED light source unit 110 needs to control the light intensity of the LED light source.

As an embodiment for controlling the light intensity of the above-described light source, the LED light source unit 110 may further include a separate test light source module (not illustrated) for preferentially performing test light emission. According to the test light emission of the test light source module, a duty ratio of a light intensity control signal of the light intensity control unit 130 may be changed. In another embodiment, the LED light source unit 110 may include one or more LED light sources. In this case, the entire light intensity of the LED light source unit 110 may be controlled on the basis of the light intensity of the one or more LED light sources.

The light source driving unit 120 generates power based on the light intensity control signal provided from the light intensity control unit 130, and provides the generated power to the LED light source unit 110.

The light intensity control signal may be provided as a square-wave signal corresponding to a pulse signal, and the light source driving unit 120 may provide an amount of power, which is proportional to the duty ratio of the light intensity control signal, to the LED light source unit 110. Thus, the light intensity of the LED light source unit 110 may be set according to the duty ratio of the light intensity control signal provided from the light intensity control unit 130. The light source driving unit 120 may perform power conversion based on the light intensity control signal. For this operation, the light source driving unit 120 may include a power conversion circuit which is switched according to the light intensity control signal. In particular, the light source driving unit 120 may include a flyback converter or AC to DC converter for converting AC power to DC power.

The light intensity control unit 130 may be designed to provide light intensity control signals for a normal mode and a light intensity control mode. The light intensity control unit 130 may provide a light intensity control signal for maintaining a light intensity in the normal mode and a light intensity control signal for controlling a light intensity through a plurality of steps in the light intensity control mode.

The light intensity control unit 130 may generate a light intensity control signal as a pulse signal having a duty ratio, that is, a digital signal or generate a light intensity control signal as an analog signal which is expressed as a change of voltage level.

The light intensity control unit 130 may include a pulse generation module 131 to generate a light intensity control signal as a digital signal. More specifically, the light intensity control unit 130 may include a pulse generation module 131, a mode conversion module 132, and a nonvolatile memory 133.

The light intensity control unit 130 outputs a pulse signal of the pulse generation module 131 as a light intensity control signal. That is, a pulse signal outputted from the pulse generation module 131 may be provided as a light intensity control signal to the light source driving unit 120.

More specifically, the pulse generation module 131 may internally generate a pulse signal which is to be outputted as a light intensity control signal. The light intensity control signal may include on and off signals which are interchanged during a predetermined cycle, and the duty ratio of the light control signal may be expressed as the ratio of the time for which the light control signal is maintained in an ON state with respect to one cycle of the pulse signal. In order to output the above-described light intensity control signal, the pulse generation module 131 may be implemented with an oscillation circuit such as a pulse width modulation (PWM) generator.

For example, when the pulse generation module 131 controls the duty ratio of the light intensity control signal in the range of 60% to 80% with respect to one cycle of the pulse signal, the light source driving unit 120 may provide an amount of power, which is proportional to the duty ratio of the light intensity control signal, to the LED light source unit 110. Then, the LED light source unit 110 is controlled to emit light at 60% to 80% of the maximum light emission level.

The duty ratio of the light intensity control signal may be controlled through the pulse generation module 131. As the duty ratio of the light intensity control signal is increased, the light source driving unit 120 may provide increased power to the LED light source unit 110. As a result, the light intensity of the LED light source unit 110 may be increased. On the other hand, as the duty ratio of the light intensity control signal is decreased, the light source driving unit 120 may provide decreased power to the LED light source unit 110. As a result, the light intensity of the LED light source unit 110 may be decreased.

The mode conversion module 132 provides information for determining a mode to the pulse generation module 131. That is, the mode conversion module 132 may change the normal mode and the light intensity control mode of the LED lighting device 100.

When the mode conversion module 132 provides information corresponding to the normal mode, the pulse generation module 131 reads digital control data stored in the nonvolatile memory 133 and outputs a light intensity control signal having a duty ratio corresponding to the digital control data. In this case, the value of the digital control data of the nonvolatile memory 133 is not updated but constantly maintained, and the pulse generation module 131 outputs a light intensity control signal for maintaining a duty ratio in response to the digital control data having a constant value. As a result, the amount of power provided to the LED light source unit 110 from the light source driving unit 120 is constantly maintained, and the LED light source unit 110 emits light at a constant light intensity.

In the case of the light intensity control mode, the mode conversion module 132 provides information indicating the light intensity control module and information for increasing or decreasing the duty ratio of the light intensity control signal to the pulse generation module 131. In response to the information, the pulse generation module 131 updates the value of the changed duty ratio of the light intensity control signal as digital control data into the nonvolatile memory 132. Thus, the duty ratio of the light intensity control signal increases or decreases in response to the light intensity control mode. Furthermore, the pulse generation module 131 updates the value of the changed duty ratio as digital control data into the nonvolatile memory 132, and provides a light intensity control signal having a duty ratio corresponding to the updated digital control data. As a result, the power provided to the LED light source unit 110 from the light source driving unit 120 is increased or decreased, and the LED light source 110 emits light at the increased or decreased light intensity.

The mode conversion module 132 may include various units to provide information through which the pulse generation module 131 can determine a mode and information for increasing or decreasing the duty ratio. For example, the mode conversion module may include a plurality of open-circuit voltage pins. The plurality of open-circuit voltage pins are represented by 210, 220, and 230 of FIG. 1, and will be described below with reference to FIG. 2.

The nonvolatile memory 133 stores digital control data on the duty ratio of a light intensity control signal, as described above. For example, the nonvolatile memory 133 may be implemented with EEPROM (Electrically erasable and programmable ROM). Whenever the duty ratio of a light intensity control signal is changed, the nonvolatile memory 133 stores the value of the duty ratio as digital control data. The digital control data stored in the nonvolatile memory 133 may be used in the normal mode or used for determining an initial light intensity in the light intensity control mode.

Figure 2:
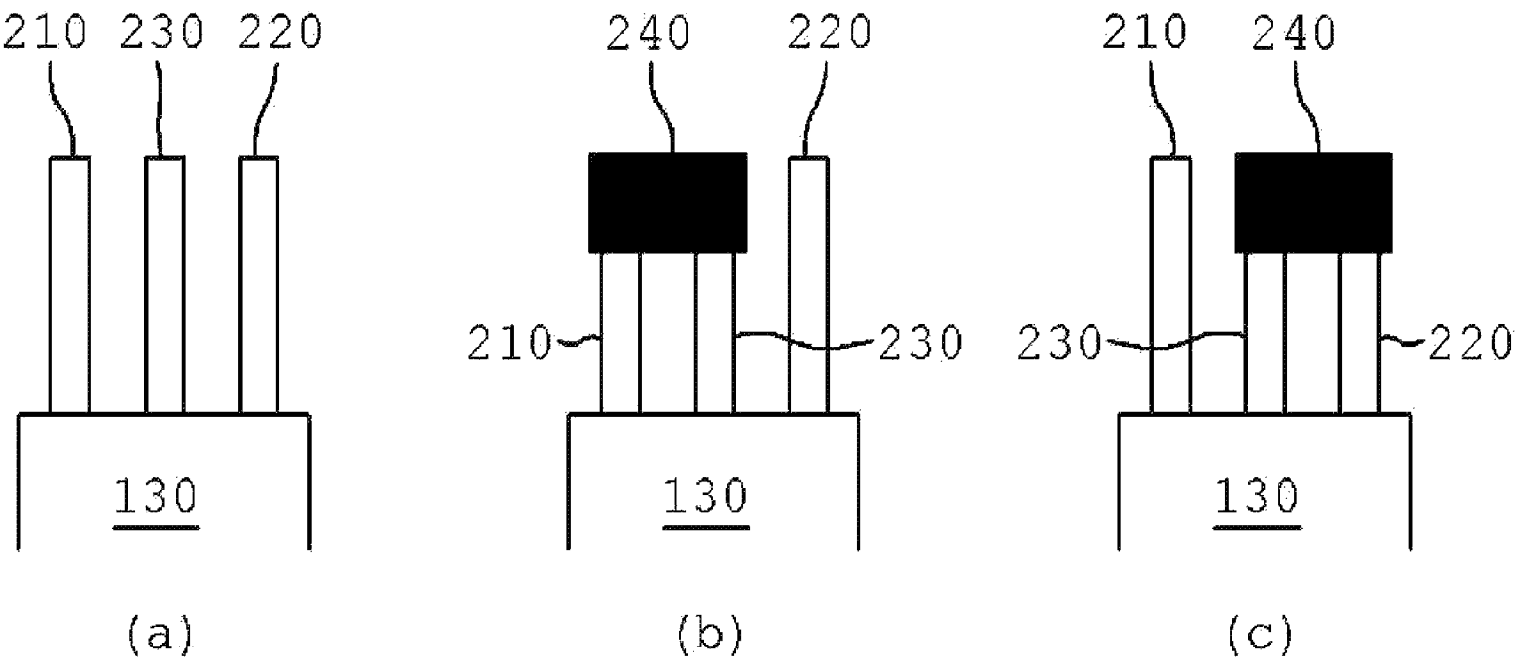
FIG. 2 is a diagram for explaining a mode conversion method using open-circuit voltage pins.

According to the embodiment of the present invention, the light intensity control unit 130 may include a plurality of open-circuit voltage pins 210, 220, and 230. Referring to FIG. 2, the plurality of open-circuit voltage pins 210 to 230 may be formed to protrude from the light intensity control unit 130. Open-circuit voltage signals of adjacent pins may be set to have different values. FIG. 2 illustrates that the plurality of open-circuit voltage pins 210 to 230 are formed on the light intensity control unit 130 implemented with a chip. As illustrated in FIG. 1, however, the plurality of open-circuit voltage pins 210 to 230 may be electrically connected to the mode conversion module 132 within the light intensity control unit 130.

In an embodiment, the plurality of open-circuit voltage pins 210 to 230 may include a first power connection pin 210, a second power connection pin 220, and a ground connection pin 230. Each of the power connection pins 210 and 220 may be connected to the ground connection pin 230 through a jumper 240. The jumper 240 may be defined to include an electric medium such as a conducting wire for electrically connecting two nodes or two terminals separated from each other on a circuit.

The mode conversion module 132 may determine whether the mode is the normal mode or the light intensity control mode, depending on a state in which the first and second power connection pins 210 and 220 and the ground connection pin 230 are electrically connected through the jumper 240.

For example, the mode conversion module 132 may be set to enter the normal mode when the first and second power connection pins 210 and 220 and the ground connection pin 230 are opened for a specific time or more after power on, as illustrated in FIG. 2A.

Furthermore, the mode conversion module 132 may be set to enter the light intensity control mode when the first power connection pin 210 and the ground connection pin 230 are electrically connected through the jumper 240 for a specific time or more after power on, as illustrated in FIG. 2B.

On the other hand, the mode conversion module 132 may be set to enter the light intensity control mode when the first power connection pin 210 and the ground connection pin 230 are electrically connected through the jumper 240 for a specific time or more after power on, as illustrated in FIG. 2B, and then the second power connection pin 220 and the ground connection pin 230 are electrically connected through the jumper 240 for a specific time or more, as illustrated in FIG. 2C.

The mode conversion module 132 may enter the normal mode or the light intensity control mode when the mode conversion is performed. When entering the light intensity control mode, the mode conversion module 132 may control the duty ratio of the light intensity control signal according to the electrical connection among the first and second power connection pins 210 and 220 and the ground connection pin 230 through the jumper 240.

According to the embodiment of the present invention, the plurality of open-circuit voltage pins 210 to 230 may be used to control the duty ratio as illustrated in FIGS. 2B and 2C. More specifically, the mode conversion module 132 may control the duty ratio of the light intensity control signal in relation with the connection time or the connection state among the first and second power connection pins 210 and 220 and the ground connection pin 230 through the jumper 240.

For example, when the first power connection pin 210 and the ground connection pin 230 are electrically connected through the jumper 240 after entering the light intensity control mode, the mode conversion module 132 may provide information for increasing the duty ratio of the light intensity control signal in stages according to a predetermined time rate, to the pulse generation module 131. On the other hand, when the second power connection pin 220 and the ground connection pin 230 are electrically connected through the jumper 240 after entering the light intensity control mode, the mode conversion module 132 may provide information for decreasing the duty ratio of the light intensity control signal in stages according to a predetermined time rate, to the pulse generation module 131.

Thus, when a difference occurs in light intensity between LED light sources because they were made by different manufacturers, the LED lighting device according to the embodiment of the present invention may correctly and precisely adjust the light intensities of the LED light sources, in comparison to the related art in which general variable resistors are used to adjust the brightness of the LED light sources.

In the LED lighting device 100 according to the embodiment of the present invention, the mode conversion module 132, or particularly, the plurality of open-circuit voltage pins 210 to 230 may be exposed to the outside such that a user conveniently performs mode conversion or duty ratio control. The plurality of open-circuit voltage pins 210 to 230 exposed to the outside may be subjected to a molding process after the light intensities of the LED light sources are adjusted. Thus, the influence of external contact or moisture may be avoided to secure the reliability of the device.

Figure 3:
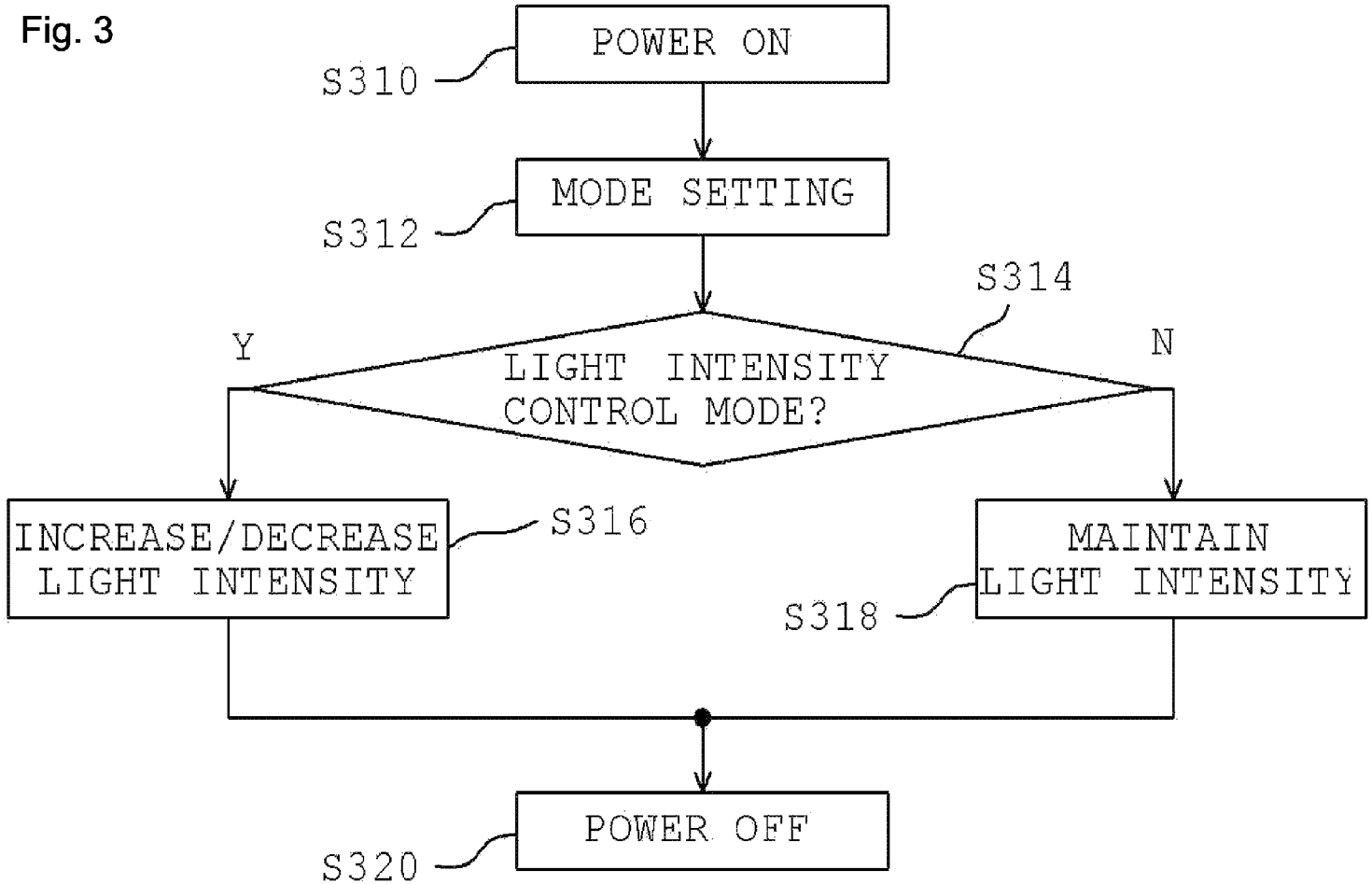
FIG. 3 is a flowchart for explaining the operation of a light intensity control unit.

FIG. 3 is a flowchart for explaining the operation of the light intensity control unit 130. The light intensity control unit 130 may set the mode by referring to the electrical connection among the plurality of open-circuit voltage pins 210 to 230 after power on, and perform the light intensity control of the LED light source unit 110 by referring to the electrical connection state among the plurality of open-circuit voltage pins 210 to 230 after setting the mode.

Specifically, after power on at step S310, the mode conversion module 132 of the light intensity control unit 130 sets the mode at step S312. Suppose that the mode is set to the normal mode when the first and second power connection pints 210 and 220 and the ground connection pin 230 are opened for a specific time or more, and set to the light intensity control mode when the first power connection pin 210 and the ground connection pin 230 are electrically connected for a specific time or more. In this case, the mode conversion module 132 may set the mode by referring to the electrical connection state among the plurality of open-circuit voltage pins 210 to 230.

Figure 4:
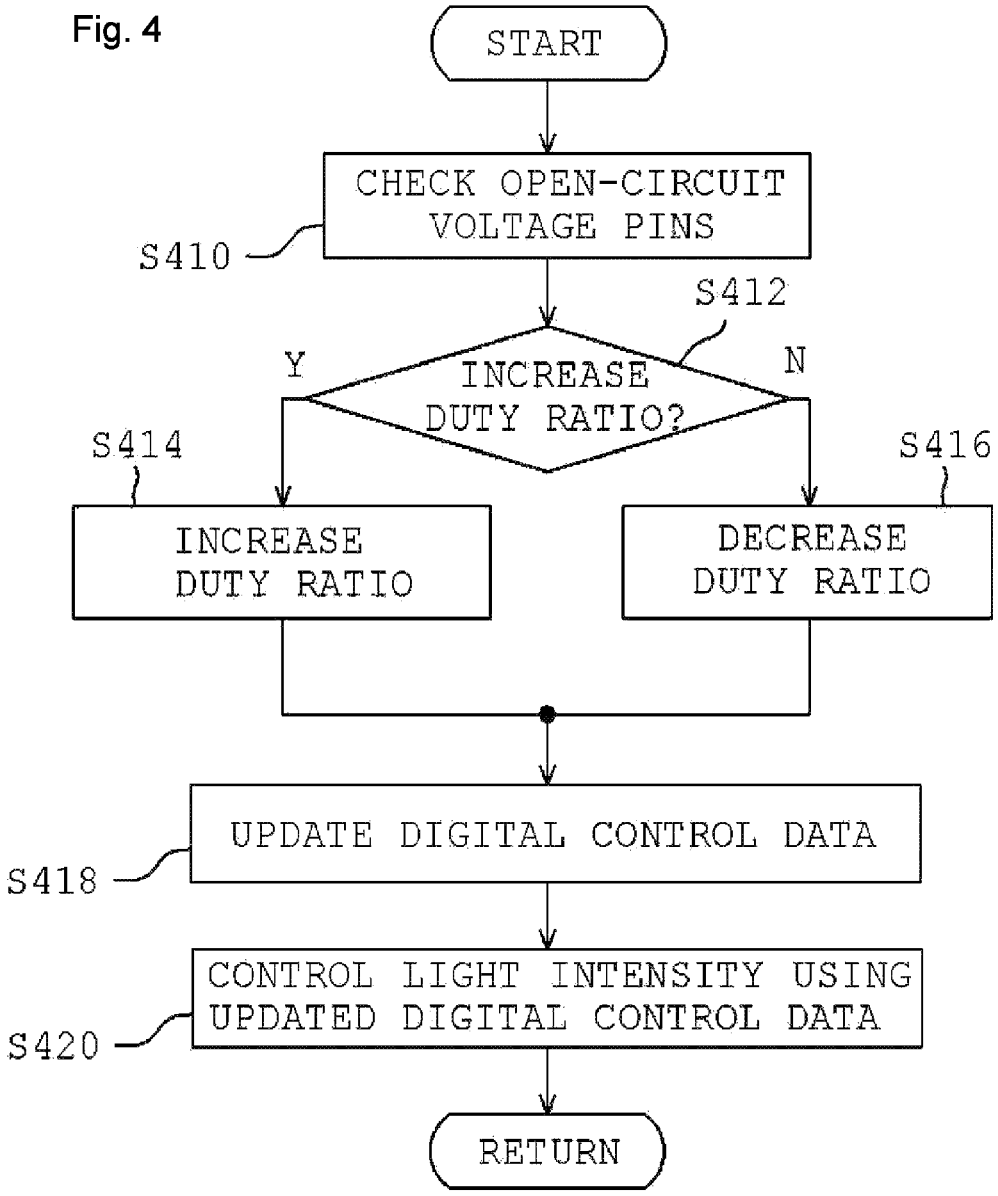
FIG. 4 is a flowchart for explaining a method for controlling a light intensity in a light intensity control mode.

Then, when the mode is set to the light intensity control mode at step S314, a process of FIG. 4 is performed at step S316. At step S316, the mode conversion module 132 and the pulse generation module 131 increase or decrease the light intensity by referring to the electrical connection state among the plurality of open-circuit voltage pins 210 to 230. On the other hand, when the mode is set to the normal mode at step S314, the mode conversion module 132 and the pulse generation module 131 maintain the light intensity at step S318. The operation based on the above-described processes may be maintained until power off at step S320.

In the normal mode, the mode conversion module 132 provides information indicating the normal mode to the pulse generation module 131, and the pulse generation module 131 recognizes the normal mode and reads digital control data from the nonvolatile memory 133. Then, the pulse generation module 131 provides a light intensity control signal maintaining a duty ratio corresponding to the digital control data to the light source driving unit 120. That is, the light intensity of the LED light source unit 110 is constantly maintained.

In the light intensity control mode, the light intensity control unit 130 performs an operation of increasing/decreasing a light intensity through the process of FIG. 4.

First, the mode conversion module 132 checks the open-circuit voltage pins at steps S410, and determines whether to increase or decrease a pulse width PWM at step S142.

That is, when the first power connection pin 210 and the ground connection pin 230 are connected through the jumper 249 for a specific time as illustrated in FIG. 2B, the mode conversion module 132 provides information for increasing the duty ratio of the light intensity control signal in stages at a predetermined rate in proportion to the connection time. When the second power connection pin 220 and the ground connection pin 230 are connected through the jumper 240 for a specific time as illustrated in FIG. 2C, the mode conversion module 132 provides information for decreasing the duty ratio of the light intensity control signal in states at a predetermined rate in proportion to the connection time.

In response to the information provided from the mode conversion module 132, the pulse generation module 131 increases the duty ratio of the light intensity control signal at step S414 or decreases the duty ratio of the light intensity control signal at step S416. Then, the pulse generation module 131 updates the value of the changed duty ratio as digital control data into the nonvolatile memory 133 in real time at step S418. Furthermore, the pulse generation module 131 generates a light intensity control signal having a duty ratio based on the updated digital control data, and provides the generated light intensity control signal to the light intensity driving unit 120 so as to control the light intensity at step S420.

Figure 5:
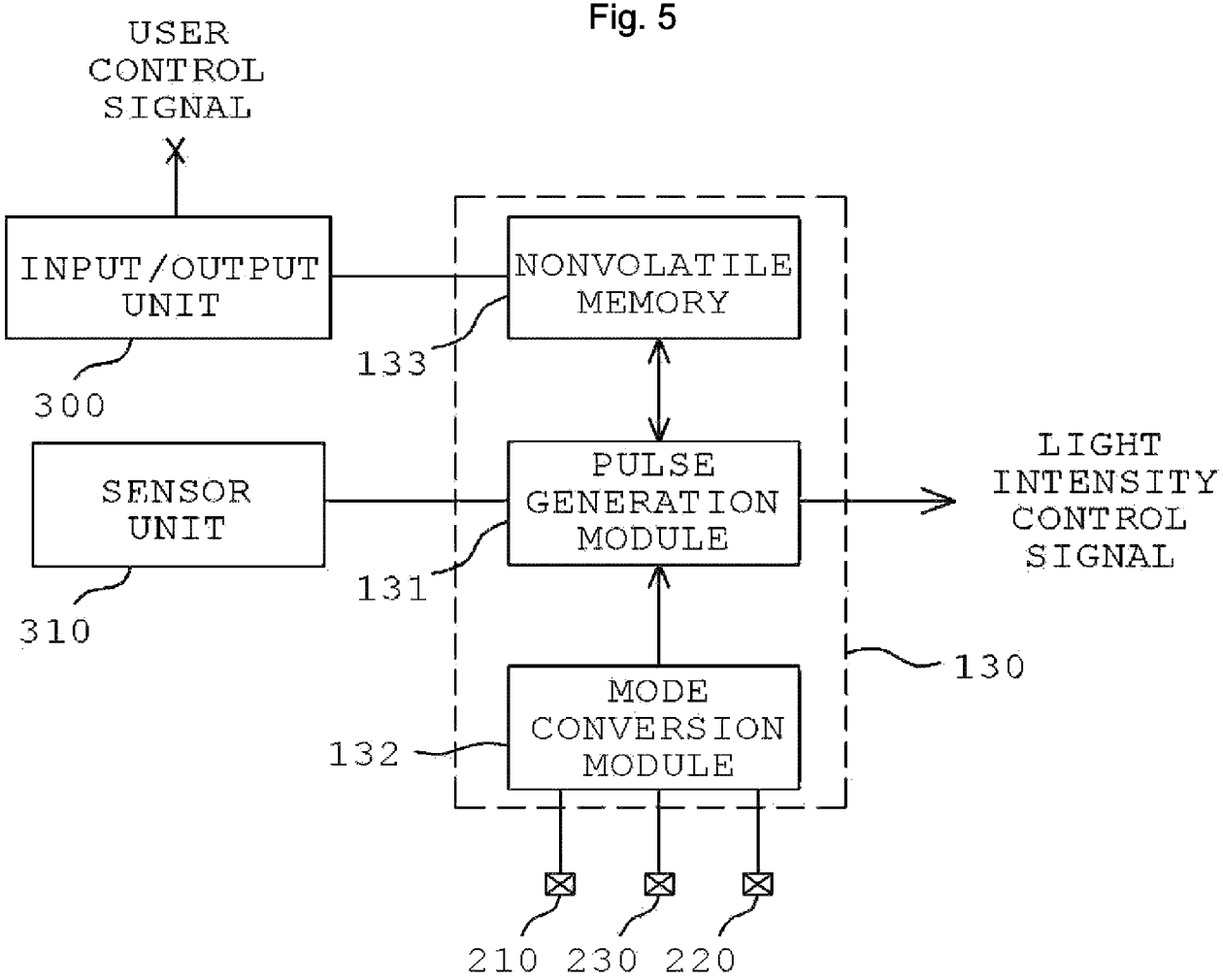
FIG. 5 is a block diagram illustrating an LED lighting device according to another embodiment of the present invention.

Referring to FIG. 5, the LED lighting device 100 according to the embodiment of the present invention may further include a sensor unit 300 and an input/output unit 310.

The sensor unit 300 may be configured to sense the change in surrounding environment of the LED lighting device 100 through a sensor and provide the sensing information to the pulse generation module 131 of the light intensity control unit 130. The sensor unit 300 may include a PIR sensor or CDS sensor. The PIR sensor may correspond to a sensor which recognizes whether an object in front of the sensor blocks infrared light, and the CDS sensor may correspond to a sensor which recognizes an illuminance difference in the surrounding environment and digitalizes the recognized illuminance difference. The pulse generation module 131 of the light intensity control unit 130 may adjust the light intensity of the LED light source unit 110 by referring to the sensing information provided from the sensor unit 300.

The input/output unit 310 may receive a user control signal corresponding to the digital control data from an external unit management terminal (not illustrated) and provide the received user control signal to the light intensity control unit 130. Setup information of the LED lighting device 100, set in the light intensity control unit 130, may be provided to the external user management terminal through the input/output unit 310.

Figure 6:
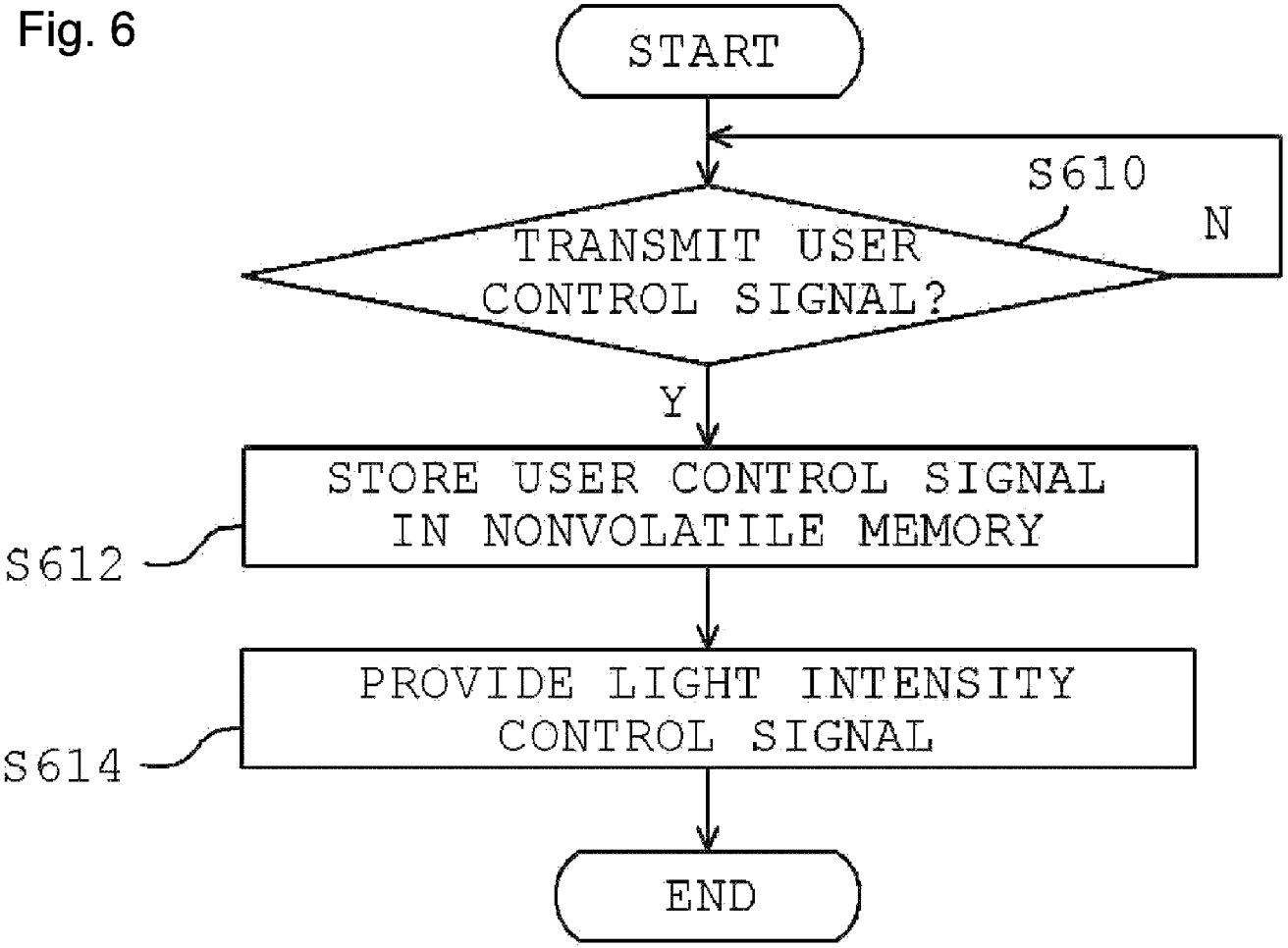
FIG. 6 is a flowchart for explaining communication between an input/output unit and a user management terminal.

FIG. 6 is a flowchart for explaining a process of communicating with the external user management terminal through the input/output unit 310.

The input/output unit 310 scans whether a user control signal is transmitted from the user management terminal at step S610. When the user control signal is transmitted from the user management terminal, the input/output unit 310 stores the user control signal as digital control data in the nonvolatile memory 133 of the light intensity control unit 130 at step S620.

Then, the pulse generation module 131 of the light intensity control unit 130 provides a light intensity control signal using the digital control data stored in the nonvolatile memory 133 at step S614.

For example, the input/output unit 310 may receive a signal for resetting the digital control data stored in the nonvolatile memory 133 from the user management terminal. The input/output unit 310 may transmit the reset signal to the nonvolatile memory 133 of the light intensity control unit 130, and the digital control data of the nonvolatile memory 133 of the light intensity control unit 130 may be reset.

According to the embodiments of the present invention, the LED lighting device may control the light intensities of LED light sources in a digital manner.

Furthermore, the LED lighting device may provide the normal mode and the light intensity control mode, resolve a difference in light intensity between LED light sources made by different manufactures, and simply change the normal mode and the light intensity control mode in relation with the connection time and the connection state among the plurality of open-circuit voltage pins, which makes it possible to provide users' convenience.

Furthermore, the LED lighting device may provide the light intensity control mode for adjusting the light intensities of LED light sources, control power provided to the LED light sources in relation with the connection time and the electrical connection state among the plurality of open-circuit voltage pins, and simply adjust the light intensities of the LED light sources having a large difference in light intensity.

Furthermore, the LED lighting device may simply control the light intensities of the LED light sources through communication using a user management terminal.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. An LED lighting device comprising:

an LED light source unit;

a light intensity control unit configured to provide a light intensity control mode, provide a light intensity control signal for changing a light intensity after entering the light intensity control mode, and set the light intensity control mode or change the light intensity control signal by referring to a connection state among a plurality of open-circuit voltage pins; and a light source driving unit configured to control a power signal provided to the LED light source unit according to the light intensity control signal.

2. The LED lighting device of claim 1, wherein the light intensity control unit provides the light intensity control signal which is expressed as a change in voltage level.

3. The LED lighting device of claim 1, wherein the light intensity control unit provides a pulse signal having a duty ratio as the light intensity control signal.

4. The LED lighting device of claim 3, wherein the light intensity control unit enters the light intensity control mode according to a combination in which at least a part of the open-circuit voltage pins are connected or opened.

5. The LED lighting device of claim 4, wherein the light intensity control unit enters the light intensity control mode when at least a part of the open-circuit voltage pins are connected and then opened and the connection state among the open-circuit voltage pins is not changed for a specific time.

6. The LED lighting device of claim 4, wherein after entering the light intensity control mode, the light intensity control unit increases the duty ratio of the light intensity control signal in stages while a part of the open-circuit voltage pins are connected, and decreases the duty ratio of the light intensity control signal in stages while another part of the open-circuit voltage pins are connected.

7. The LED lighting device of claim 6, wherein the light intensity control unit stores the changed light intensity control signal as digital control data in a nonvolatile memory, and generates and outputs the light intensity control signal using the stored digital control data.

8. The LED lighting device of claim 4, wherein the light intensity control unit comprises:

a mode conversion module comprising the plurality of open-circuit voltage pins and configured to provide information for changing the mode or the duty ratio according to the combination in which a part of the open-circuit voltage pins are connected or opened; and a pulse generation module configured to recognize a normal mode and the light intensity control mode according to the information provided from the mode conversion module and generate the light intensity control signal of which the duty ratio is changed in response to the light intensity control mode.

9. The LED lighting device of claim 8, wherein the light intensity control unit further comprises a nonvolatile memory configured to store digital control data, and the pulse generation module updates the value of the light intensity control signal, of which the duty ratio was changed, as the digital control data into the nonvolatile memory, and generates and outputs the light intensity control signal using the digital control data updated into the nonvolatile memory.

10. The LED lighting device of claim 9, wherein at least the plurality of open-circuit voltage pints in the LED lighting device are subjected to a molding process for a waterproof function.

11. The LED lighting device of claim 3, wherein the light intensity control unit enters a normal mode according to a combination in which at least a part of the open-circuit voltage pins are connected or opened, and generates and outputs the light intensity control signal using digital control data stored in a nonvolatile memory in the normal mode.

12. The LED lighting device of claim 1, wherein the LED light source unit comprises one or more LED light sources, and the light intensity control unit controls the entire light intensity of the LED light source unit based on the brightness of the one or more LED light sources.

13. An LED lighting control method comprising:

recognizing any one of a normal mode for maintaining a light intensity of an LED light source by referring to a connection state among a plurality of open-circuit voltage pins and a light intensity control mode for controlling the light intensity of the LED light source in stages;

performing the normal mode for maintaining the light intensity of the LED light source by maintaining a duty ratio of a light intensity control signal provided from a pulse generation module in response to the normal mode; and performing the light intensity control mode for controlling the light intensity of the LED light source by increasing or decreasing the duty ratio of the light intensity control signal provided from the pulse generation module in response to the light intensity control mode.

14. The LED lighting control method of claim 13, wherein the performing of the light intensity control mode comprises increasing or decreasing the duty ratio of the light intensity control signal by referring to the connection state among the plurality of open-circuit voltage pins.

* * * * *